United States Patent [19]

Goodman

[11] 4,166,370

[45] Sep. 4, 1979

[54] TANDEM ROLL GROOVER

[75] Inventor: James M. Goodman, East Rochester, N.Y.

[73] Assignee: E.G.S Manufacturing Corp., East Rochester, N.Y.

[21] Appl. No.: 892,383

[22] Filed: Mar. 31, 1978

[51] Int. Cl.[2] ..... B21D 17/04

[52] U.S. Cl. ..... 72/105; 72/442

[58] Field of Search ..... 72/105, 106, 226, 442; 74/16

[56] References Cited

U.S. PATENT DOCUMENTS

| | | | |
|---|---|---|---|
| Re. 16,931 | 4/1928 | Pritchard | 72/226 |
| 1,205,605 | 11/1916 | Eligh | 72/106 |
| 3,903,722 | 9/1975 | Thau, Jr. et al. | 72/105 |

FOREIGN PATENT DOCUMENTS

| | | | |
|---|---|---|---|
| 560459 | 7/1958 | Canada | 72/105 |

*Primary Examiner*—Lowell A. Larson

*Attorney, Agent, or Firm*—Shlesinger, Fitzsimmons & Shlesinger

[57] ABSTRACT

A single electric motor is employed to drive two, separate backup roll supporting shafts which are mounted to rotate about a common horizontal axis. A first, solid, cylindrical backup roll of relatively small diameter (less than 1½") is secured to one end of one of said shafts for rotation beneath a first grooving roll, and a second, relatively larger diameter backup roll (greater than 1½" and less than 2"), which is annular in configuration, is secured coaxially to one end of the other shaft for rotation thereby beneath a second grooving roll. Each grooving roll is mounted for vertical reciprocation by springs and by a hydraulic ram supplied by fluid from a separate hand pump. Means is also provided for adjustably limiting the descent of each backup roll.

7 Claims, 2 Drawing Figures

TANDEM ROLL GROOVER

Figure 1:
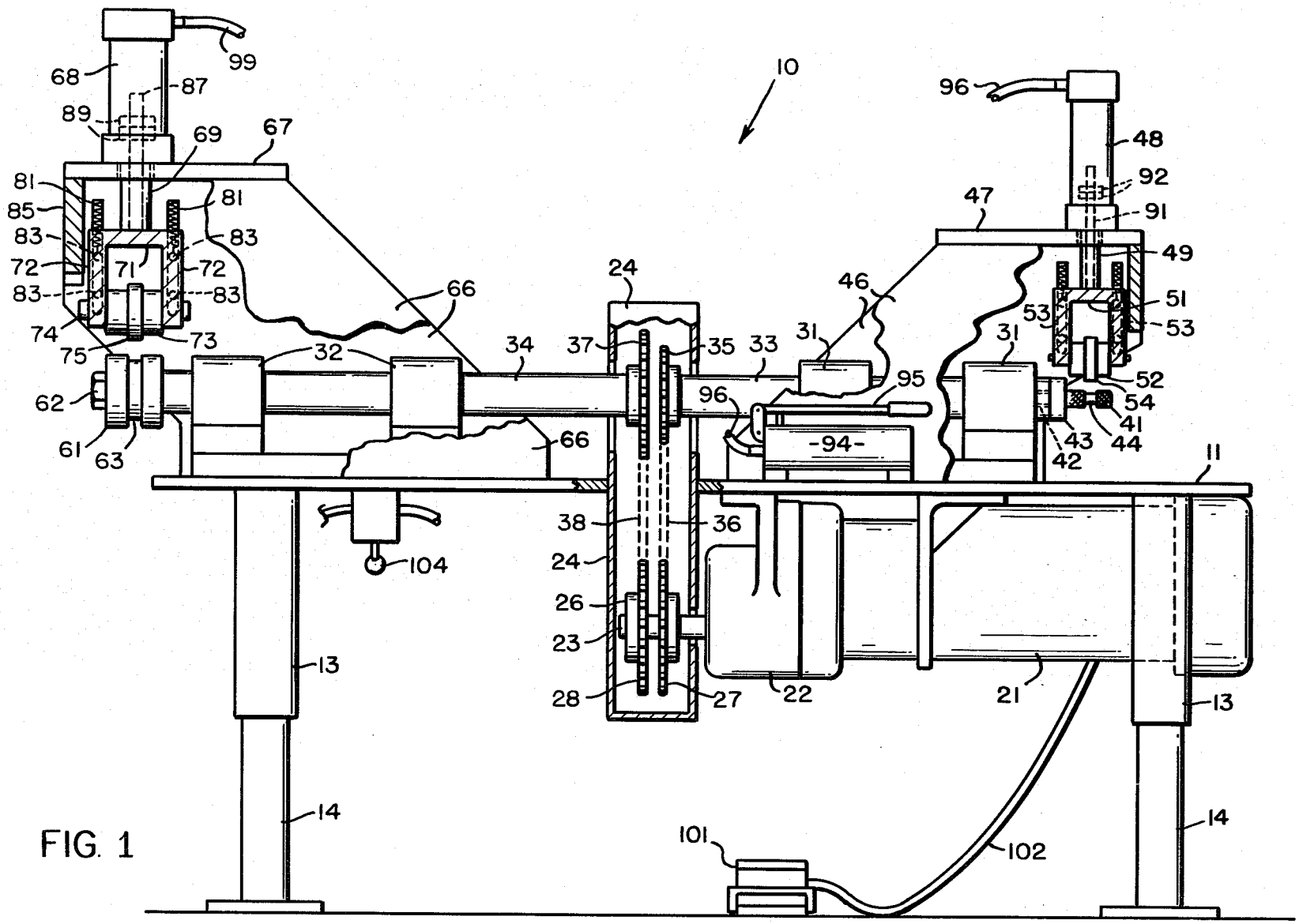

This invention relates to roll groovers for thin walled pipe, and more particularly to a tandem roll groover machine which is capable of grooving both relatively large and small diameter pipe.

Known devices for grooving thin walled pipe comprise, typically, a grooved backup roll over which is inserted one end of a section of thin walled pipe which is to be grooved. The backup roll is positioned beneath a vertically movable grooving roll, which has on its outer peripheral surface a circumferential boss, or projection, which registers with the groove in the backup roll. In use, the backup roller is rotated, and the rotatable grooving roll is forced vertically downwardly into engagement with the thin walled pipe, which then begins to rotate as the result of frictional contact between the pipe and the grooved backup roll. As the grooving roll descends it deforms the thin walled pipe downwardly into the registering groove in the backup roll, thus forming an annular groove in the pipe adjacent said one end thereof.

As pointed out in my copending U.S. patent application Ser. No. 792,249, which was filed Apr. 29, 1977, now U.S. Pat. No. 4,114,414, issued Sept. 19, 1978, and which is entitled Backup Roll For Thin Walled Pipe Grooving Device, difficulty has been encountered heretofore when grooving thin walled pipes of rather small diameters, for example pipes having diameters of ½ inch or less. To solve this problem, my above-noted application disclosed in novel, solid backup roll attachment, which is adapted to be employed in place of the usual, annular-type of backup roll. While this novel backup roll has the advantage that it enables an operator to use the same grooving device or machine on both relatively small and large diameter pipes, it nevertheless requires some modification of the existing, or conventional grooving machine; and it also necessitates shutting down a machine each time one type of backup roll is to be removed and replaced by the other.

Accordingly, it is an object of this invention to provide an improved roll grooving machine which has the capabilities of grooving both relatively small and large diameter thin walled pipe without having to shut down the machine and make a substitution of one type of backup roll for another.

Another object of this invention is to provide an improved roll grooving machine of the type described which greatly facilitates the grooving of thin walled pipe by enabling simultaneous grooving of both small and relatively large diameter piping, if desired.

Still another object of this invention is to provide an improved roll grooving machine which utilizes a single driving mechanism for operating two separate sets of grooving rolls.

A further object of this invention is to provide a tandem roll grooving device having two sets of grooving rolls which can be operated, optionally, either in unison or individually.

Figure 2:
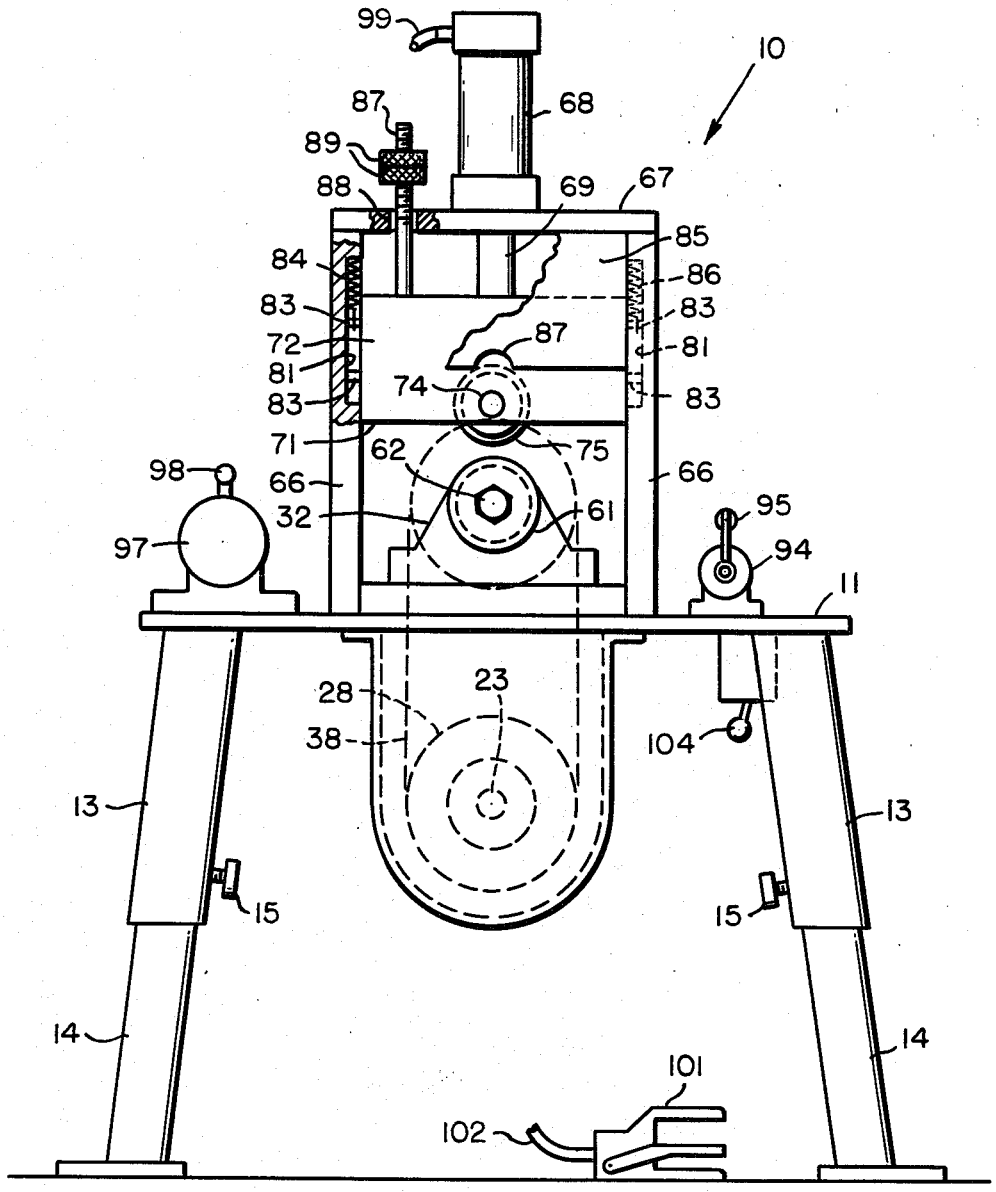

Other objects of the invention will be apparent hereinafter from the specification and from the recital of the appended claims, particularly when read in conjunction with the accompanying drawings. In the drawings:

FIG. 1 is a fragmentary, front elevational view of a tandem roll grooving machine made according to one embodiment of this invention, portions of the machine being cut away and shown in section for purposes of illustration; and FIG. 2 is a fragmentary end elevational view of this machine, as seen when looking towards the left end of machine as shown in FIG. 1.

Referring now to the drawings by numerals of reference, 10 denotes generally a tandem roll grooving machine comprising a base plate 11, which is generally rectangular in configuration, and which is supported adjacent its corners on the upper ends of four, spaced, telescopically adjustable legs 13. The lower section 14 of each leg 13 is slidable at its upper end telescopically in the lower end of the upper, tubular leg section, and is adapted to be secured adjustably relative to its upper section by a pair of adjusting nuts 15 (FIG. 2) which thread into each upper section for engagement at their inner ends with the lower sections 14.

Secured to the underside of plate 11 adjacent one end thereof is an electric motor 21, having an output shaft which is drivingly connected to a speed reducer 22 that is also mounted beneath path 11 adjacent one end of the motor 21. The output shaft 23 of the speed reducer projects into one side of a drive housing 24, which is secured intermediate its ends in a central opening in base plate 11. Secured to the shaft 23 for rotation thereby in the housing 24 is the hub 26 of a double sprocket having thereon a pair of axially-sapced sprocket wheels 27 and 28. In the embodiment illustrated, the two wheels 27 and 28 are shown to be the same size, and merely by way of example, each may have thereon twenty-one teeth.

Secured to the surface of the base plate 11 adjacent opposite ends thereof are two pairs of spaced pillow blocks 31 and 32, respectively, the bores of which are axially aligned. Rotatably journaled intermediate its ends in the bores of the pillow blocks 31 is a first, backup roll supporting shaft 33, one end of which (the left end as shown in FIG. 1) projects into one side of the drive housing 24 where the latter projects above the upper surface of plate 11. Rotatably journaled intermediate its ends in the bores of the other two pillow blocks 32 is a second backup roll supporting shaft 34, which also projects at one end (its right end in FIG. 1) into the upper end of housing 24 in spaced, coaxial relation to the inner end of shaft 33. Secured to the inner end of shaft 33 in housing 24 is a sprocket wheel 35, the teeth of which are connected by a chain 36 to the teeth of wheel 27 on the speed reducer shaft 23. Similarly, a sprocket wheel 37, which is secured to the inner end of shaft 34 in housing 24, is drivingly connected by a further chain 38 to the sprocket wheel 28.

In the embodiment illustrated, the sprocket wheel 35 is smaller than the wheel 37, and has thereon thirteen teeth, as compared for example to twenty-one teeth on the wheel 37. As a consequence, when the wheels 35 and 37 are driven through chains 36 and 38 by the wheels 27 and 28, the shaft 33 will be rotated at a slightly higher speed than that of the shaft 34. These relative speeds and sprocket wheel sizes as disclosed herein are given merely by way of example.

Secured to the outer end of shaft 33 coaxially thereof is a solid, cylindrical backup roll 41, which may be similar in configuration to the backup roll disclosed in my above-noted copending U.S. patent application Ser. No. 792,249. Roll 41 has a threaded shank portion 42, which is threaded into an axial bore formed in the outer end of shaft 33 coaxially thereof. An external, circumferential shoulder 43 is formed on roll 41 intermediate its ends for engagement with the outer, terminal end of shaft 33 to limit the extent to which the roll can be threaded into shaft 33. Forwardly, or to the right of the shoulder 43 as shown in FIG. 1, roll 41 has in its peripheral surface an annular groove 44, which is used to form a groove in thin walled pipe as noted hereinafter.

Secured on the base plate 11 adjacent opposite sides of shaft 33, and outwardly of the pillow blocks 31, are two, spaced, parallel, vertically disposed side plates 46. Secured to and extending transversely between the upper edges of plates 46, and overlying the backup roll 41, is a horizontally disposed coverplate 47. Secured at its lower ends on the plate 47 above and in registry with the groove 44 in the backup roll 41 is the cylindrical housing 48 of a hydraulic ram. Projecting out of the lower end of housing 48 and through a registering opening in the cover plate 47 is a vertically reciprocable ram or piston rod 49, the lower end of which engages an inverted, generally U-shaped yoke member 51. Member 51 is mounted between plates 46 for vertical reciprocation above roll 41 in a manner which will be apparent hereinafter. It carries a rotatable grooving head or roll 52, opposite ends of which are rotatably journaled in the legs 53 of yoke 51 to rotate therebetween about an axis which extends parallel to, and is in the same vertical plane as, the axis of the backup roll 41. The grooving head 52 has thereon the usual circumferential grooving boss or operating surface 54, which registers with, and is complimentary to, the groove 44 in the backup roll 41.

At the opposite end of base plate 11 an annular backup roll 61 is secured by a bolt 62 coaxially to the outer end of shaft 34, and has in its peripheral surface an annular groove 63, which is designed to groove thin walled pipe having a diameter larger than the type of pipe which is designed to be grooved by the backup roll 41. Also at this end of the base plate, two, spaced, parallel side walls 66 project upwardly from the plate 11 and support on their upper ends a horizontally disposed cover plate 67, which overlies the backup roll 61. The housing 68 of a further ram is secured on plate 67 above and in registry with the backup roll 61, and has a reciprocable operating ram or rod 69 which projects downwardly through a registering opening in plate 67.

The lower end of ram 69 engages the closed end of an inverted, generally U-shaped yoke member 71, which carries between its legs 72 a rotatable grooving head or roll 73. This roll is mounted on a shaft 74 which is rotatably journaled at opposite ends in the legs 72 of the yoke member 71, and has on its outer peripheral surface a circumferential boss or operating surface 75, which registers with the groove 63 in the backup roll 61 for grooving thin wall pipe in a manner that will be apparent hereinafter.

Each side plate 66 has in its inner surface a pair of spaced, parallel, vertically extending grooves 81, which register with a like pair of grooves in the opposite side wall 66, and with the legs 72 of yoke member 71. Each leg 72 of member 71 has on each of its opposed end surfaces guide means in the form of, for example, a pair of spaced, cylindrical pins 83, which project slidably into one of the grooves 81 (see FIG. 2) to guide the legs 72 of the yoke member for vertical reciprocation between plates 66, and rearwardly of a partial cover plate 85 (FIG. 2) which extends between the outer edges of plates 66.

The yoke member 71 normally is urged upwardly and toward the lower end of the ram 69 by means of a plurality of tension springs 86, which are mounted in the upper ends of the grooves 81 in the sideplates, with one end of each spring 86 fixed to the upper end of the associated groove 81, and secured at its lower end to the uppermost guide pin 83 of the associated pair thereof. When the ram 69 is fully retracted, the springs 86 draw the yoke member 71 to its uppermost position in which one end of shaft 74 is engageable in a recess 87 in the lower edge of cover plate 85.

A pin or bolt 87 is secured at one end to the upper end of yoke member 71, and projects at its upper end slidably through a registering opening 88 in plate 67. A pair of nuts 89 is threadably adjusted onto the upper end of bolt 87 with the lower of the two nuts being engageable with plate 67, when the ram 69 is operated to lower the yoke member 71, thereby to limit the extent to which the grooving roller 61 can be lowered.

Although not so described in detail herein, it will be understood that the yoke member 51 is guided for movement between plates 46 by guide means of the type described in connection with member 71; and member 51 likewise carries a bolt 91 having thereon adjusting nuts 92 engageable with plate 47 adjustably to limit the descent of grooving roll 52.

Secured on the surface of base plate 11 outwardly of one of the side walls 46 is a hydraulic hand pump 94, which has thereon a pivotal operating handle 95, which can be manipulated in known manner in order to develop pressure in the cylinder 94. The discharge end of cylinder 94 is connected by flexible tubing 96 to the upper end of the ram housing 48. The housing 97 for a similar but larger hand pump is secured also on plate 11 adjacent the opposite end thereof, and outwardly of one of the side walls 66 (the left hand side wall as illustrated in FIG. 2). Pivotally mounted on housing 97 is the pump operating arm 98, which is adapted to be operated manually in the manner similar to the arm 95 for the pump 94. The output or outlet of the pump housing 97 is connected by flexible tubing 99 to the upper or inlet end of the ram housing 68.

In use, the motor 21 is adapted to be turned on and off by a manually-operable switch, such as for example by a foot switch denoted at 101 (FIG. 1), which may be connected by a lead 102 in any conventional manner to the motor 21. Preferably the motor is a reversible, AC motor, the direction of rotation of which is controlled by a manually-operable switch 104, which is mounted on the underside of the base plate 11 as illustrated in FIG. 1. In one position switch 104 causes the shafts 33 and 34 to rotate in one direction, and in a second position it causes the shafts to rotate in the opposite direction. If switch 104 is of the three-position variety, it can be connected in circuit with motor 21 to stop rotation of its armature notwithstanding the fact that switch 101 is closed. A three-position switch of this type is particularly useful in those cases where it might be desirable to rotate the shaft 34 in one direction during use of the grooving roll 73, and to rotate shaft 33 in the opposite direction, when utilizing the grooving roll 52. Of course, in those cases where the shafts 33 and 34 are designed to rotate in the same direction during use, the use of a reversible motor 21 would not be necessary. In such case also, it would be possible to operate both of the grooving rolls 52 and 73 simultaneously.

Whenever pipe is to be grooved on the backup roll 41 or 61, the associated hand pump 94 or 97 is operated either to cause the ram 49 or 69 to drive the associated yoke member 51 or 71 downwardly to the extent permitted by the associated limiting mechanism represented by a bolt 91 and nuts 92, or by the bolt 87 and nuts 89. At this time the section of pipe which is to be grooved is held over the now-rotating backup roll 41 or 61, so that the moment that the pipe is engaged by the operating boss 54 or 75 on the associated grooving roll 52 or 73, the pipe that is to be grooved is clamped firmly between the now-descending grooving roll and the associated backup roll 41 or 61. Consequently, the pipe is question now begins to rotate, and as the associated grooving roll 52 or 73 continues to descend, it causes an annular groove to be formed in the rotating pipe. After the groove has been formed in the pipe section, the pressure in the associated ram cylinder 48 or 68 is released by a conventional valve mechanism (not illustrated), so that the ram 49 or 69 is free to return to its retracted (upper) position in response to the force generated on the associated yoke member by its retracting springs, such as those denoted at 86 in FIG. 2. The now-grooved pipe is thereby released and removed from over the associated backup roll 41 or 61.

From the foregoing it will be apparent that applicant has devised a relatively simple and inexpensive machine for enabling the production of both relatively large and relatively small diameter thin walled pipe on the same machine, and without requiring any shut down of the machine for substitution of one type of backup roll for another. The drive mechanism which forms part of this novel machine not only permits both the small (41) and the large (61) backup rolls to be driven simultaneously, but also provides for driving these rolls at different rates. Moreover, each of the grooving rolls 52 and 73 is provided with means for limiting the extent to which the grooving roll will be driven downwardly during an operating sequence, thereby enabling the depth of the groove produced in the thin walled pipe to be controlled merely by adjusting the nuts 89 or 92.

While in the embodiment illustrated it has been suggested that manual hand pumps be employed for supplying hydraulic fluid to the ram operating cylinders 48, 68, it will be apparent to one skilled in the art that automatically operated hydraulic supply means could likewise be employed utilizing, for example, a common sump from which hydraulic fluid is supplied selectively to the housings 48 and 68, after which the exhausted fluid would be returned to the sump or reservoir. Likewise, as noted above, the exact type of electrical motor which is utilized to drive the shafts 33 and 34, and the respective rates at which the shafts are rotated can be changed depending upon the type of thin walled pipe that is to be grooved.

Moreover, while only a single embodiment of this invention has been illustrated and described in detail herein, it will be apparent that the invention is capable of still further modification, and that this application is intended to cover any such modifications as may fall within the scope of one skilled in the art or the appended claims.

Having thus described my invention, what I claim is:

1. A tandem roll grooving device for grooving thin walled pipe of various diameters, comprising a base, a pair of spaced shafts mounted on said base for rotation independently of each other about stationary axes, a drive motor on said base, means connecting both of said shafts to said motor to be driven thereby simultaneously, a first backup roll secured to and projecting coaxially beyond one end of one of said shafts for rotation thereby, a second backup roll secured to and projecting coaxially beyond one end of the other of said shafts for rotation thereby, a pair of spaced, rotatable grooving rolls, and stationary means fixed on said base and supporting said grooving rolls for vertical movement above said backup rolls, each of said grooving rolls having on its periphery a circumferential boss registering with a groove in one of said backup rolls for operative engagement with a section of thin walled pipe positioned thereover, one of said backup rolls being annular in configuration, the other of said backup rolls being a solid cylindrical member, and each of said backup rolls being supported during a grooving operation solely by said one end of the shaft to which it is secured.

2. A tandem roll grooving device as defined in claim 1, wherein said one backup roll has an outside diameter greater than that of said other backup roll, and is disposed to be used in grooving thin walled pipe having diameters in the range of from two inches to twelve inches, and said other backup roll has an outside diameter less than one inch, and is disposed to be used in grooving thin walled pipe having a diameter of one and one half inch or less.

3. A tandem roll grooving device as defined in claim 2, including means mounting said shafts on said base for rotation coaxially about a common axis, and selectively in opposite directions about said common axis.

4. A tandem roll grooving device as defined in claim 3, wherein said connecting means includes means for rotating said one shaft faster than said other shaft, and said other backup roll is secured to said one shaft, whereby it is rotated faster than said one backup roll.

5. A tandem roll grooving device as defined in claim 4, wherein said drive means comprises an electric motor fastened to the underside of said base, and having a speed reducer connected to its armature, a separate sprocket wheel is fixed to each of said shafts adjacent the opposite end thereof, and said connecting means comprises a double sprocket wheel mounted on the output of said speed reducer, and a pair of chains connecting said double sprocket wheel to said separate sprocket wheels on said spaced shafts.

6. A tandem roll grooving device for grooving thin walled pipe, comprising a base plate supported horizontally on a plurality of spaced legs, a pair of spaced shafts mounted on said plate for coaxial rotation about a common horizontal axis, and having a pair of spaced, confronting ends registering with an opening in siad base plate, an electric motor secured to the underside of said base plate, means extending through the opening in said plate and drivingly connecting each of said shafts to the armature of said motor to be rotated thereby, a pair of grooved backup rolls secured, respectively, to the ends of said shafts remote from the confronting ends thereof, means for supporting a pair of grooving rolls on said base plate for vertical reciprocation above said backup rolls, each of said grooving rolls registering with one of said backup rolls and having thereon a circumferential boss registering with a groove in the periphery of the registering backup roll, and hydraulic means for selectively lowering each of said grooving rolls from a inoperative to an operative position in which its boss projects into the groove in the registering backup roll, said connecting means including means for simultaneously driving said shafts selectively in one or the other direction about said common axis, said supporting means comprising a pair of spaced, confronting side plates fixed to and projecting vertically upwardly from said base plate adjacent opposite sides of each of said backup rolls, a yoke member mounted for limited vertical movement between each pair of said side plates and above one of said backup rolls, means rotatably mounting each of said grooving rolls between the legs of one of said yoke members for movement thereby toward and away from the registering backup roll, and spring means urging each of said yoke members into one of its limit positions relative to the pair of side plates between which it is mounted.

7. A tandem roll grooving device as defined in claim 6, wherein one of said backup rolls is a solid, cylindrical member threaded at one end coaxially into one of said shafts, and the other backup roll is an annular member having an outside diameter greater than that of said one backup roll, and said connecting means further includes means for rotating said one shaft faster than the other shaft of said pair.

* * * * *